US010233766B2

(12) United States Patent
Heaven et al.

(10) Patent No.: US 10,233,766 B2
(45) Date of Patent: Mar. 19, 2019

(54) BLADE OF A ROTARY FLOW MACHINE WITH A RADIAL STRIP SEAL

(71) Applicant: ANSALDO ENERGIA SWITZERLAND AG, Baden (CH)

(72) Inventors: Sarah Heaven, Warwickshire (GB); Shyam Mavani, Leicester (GB); Jiwen Tao, Rugby Warwickshire (GB); Stacie Tibos, Rugby Warwickshire (GB); Vasileios Stefanis, Niederrohrdorf (CH); Sascha Justl, Zurich (CH); Rudolf Kellerer, Waldshut-Tiengen (DE)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 0 days.

(21) Appl. No.: 15/860,180

(22) Filed: Jan. 2, 2018

(65) Prior Publication Data

US 2018/0156055 A1 Jun. 7, 2018

Related U.S. Application Data

(62) Division of application No. 14/467,752, filed on Aug. 25, 2014, now Pat. No. 9,890,651.

(30) Foreign Application Priority Data

Aug. 29, 2013 (EP) ..... 13182178

(51) Int. Cl.
*F01D 11/00* (2006.01)
*F01D 5/30* (2006.01)

(52) U.S. Cl.
CPC ..... *F01D 11/006* (2013.01); *F01D 5/30* (2013.01); *F01D 11/00* (2013.01); *F01D 11/005* (2013.01);

(Continued)

(58) Field of Classification Search
CPC ..... F01D 11/005; F01D 11/006; F01D 11/00; F01D 5/30; F05D 2240/57; F05D 2250/75; F05D 2240/81
See application file for complete search history.

(56) References Cited

U.S. PATENT DOCUMENTS 3,975,114 A 8/1976 Kalkbrenner
4,523,890 A 6/1985 Thompson
(Continued)

FOREIGN PATENT DOCUMENTS

CN 101929357 A 12/2010
CN 102465718 A 5/2012
(Continued)

OTHER PUBLICATIONS

Office Action (First Office Action) dated Jan. 3, 2017, by the Chinese Patent Office in corresponding Chinese Patent Application No. 201410433623.8, and an English Translation of the Office Action. (17 pages).

(Continued)

*Primary Examiner* — Atif Chaudry
(74) *Attorney, Agent, or Firm* — Buchanan Ingersoll & Rooney PC

(57) ABSTRACT

The invention refers to a blade of a rotary flow machine including an airfoil having a suction surface and a pressure surface joining each other along a trailing and a leading edge. A radially outward directed airfoil tip and a radially inward directed end joining an inner platform connect the airfoil to a shank at a radial end of the airfoil and providing, at least one shank pocket radially encircled by an axially extending portion of the platform. At least one radially extending rim extends from the trailing edge side of the shank and has an essentially radially orientated first slot for receiving a seal. A mount extends radially inwardly from (Continued)

said shank pocket. The first slot has a first aperture on a shank surface orientated in an axial direction.

3 Claims, 6 Drawing Sheets

(52) U.S. Cl.
CPC ..... *F05D 2240/57* (2013.01); *F05D 2240/81* (2013.01); *F05D 2250/75* (2013.01)

(56) References Cited

U.S. PATENT DOCUMENTS

| | | | |
|---|---|---|---|
| 6,086,329 | A | 7/2000 | Tomita et al. |
| 6,561,764 | B1 | 5/2003 | Tiemann |
| 8,226,365 | B2 | 7/2012 | Roush et al. |
| 8,790,086 | B2 | 7/2014 | Honkomp et al. |
| 2010/0178173 | A1 | 7/2010 | Charlton |
| 2010/0272568 | A1 | 10/2010 | Roush et al. |
| 2012/0049467 | A1 | 3/2012 | Stewart et al. |
| 2012/0121423 | A1 | 5/2012 | Honkomp et al. |
| 2012/0237352 | A1 | 9/2012 | Boyer et al. |
| 2013/0094969 | A1 | 4/2013 | Amaral et al. |

FOREIGN PATENT DOCUMENTS

| | | | |
|---|---|---|---|
| CN | 103047015 | A | 4/2013 |
| EP | 2 584 151 | A2 | 4/2013 |
| GB | 2 452 515 | A | 11/2009 |
| WO | 00/57031 | A1 | 9/2000 |

OTHER PUBLICATIONS

Office Action (Communication) dated Mar. 3, 2017, by the European Patent Office in corresponding European Patent Application No. 14179109.5. (5 pages).

BLADE OF A ROTARY FLOW MACHINE WITH A RADIAL STRIP SEAL

CROSS-REFERENCE TO RELATED APPLICATIONS

This application claims priority to European application 13182178.7 filed Aug. 29, 2013, the contents of which are hereby incorporated in its entirety.

TECHNICAL FIELD

The invention concerns a blade of a rotating flow machine. The blade comprising, an airfoil having a suction surface and a pressure surface joined together along a trailing and a leading edge, a radially outwardly extending airfoil tip and a radially inward extending end joining an inner platform connecting the airfoil to a shank located at a radial end of the airfoil. The shank includes at least one shank pocket whose radially outwardly extending point is encircled by a portion of the platform that extends axially. At least one radially extending rim extends from the trailing edge side of the shank and has a radially orientated slot for receiving a seal. A mount extends radially inwardly from the shank pocket.

BACKGROUND

Blades of a rotary flow machine, such as a compressor unit or a turbine stage of a gas turbine arrangement, are typically circumferentially arranged on a plurality of axially ordered rotor wheels. The platforms of each blade delimit the working channel of the rotary flow machine, which in case of a turbine stage is the hot gas channel where hot gases emerging from an upstream combustor expand and convert kinetic energy into rotational mechanical energy. Highly-compressed air is typically extracted from the compressor unit of an axial turbine for the purpose of cooling turbine components, particularly those in the hot gas path downstream of the combustor. The cooling air is required to maintain the temperature of the turbine components at an acceptable level for operation, but comes at a cost to overall turbine efficiency and output. Therefore it is important to reduce any cooling flow leakage out of the turbine components.

The area between adjacent blades in a common blade row of a rotor wheel radially inward of the platforms of each blade is typically referred to as a shank pocket. Typically, cavities between rotating blades and axially adjacent stationary components axially forward and aft of each shank pocket operate at different pressures to enable a natural fluid flow from the higher pressure cavity to the lower pressure cavity through the gaps which are necessary for movement and expansion between adjacent rotating blades. Each of these gaps has a large leakage path for cooling flow to escape from the shank region of the blade. The cooling efficiency can also be impaired by ingress of hot gas from the hot gas path into the shank region.

Document EP 2 584 151 A2 discloses a sealing system for a turbine rotor blade having at least one shank pocket encircled radially outwardly by an axially extending portion of the platform. At least one radially directed rim extending from the trailing edge side of the shank has a radially orientated first slot for receiving a seal. The seal may be a strip seal comprising an arm portion and a hook portion wherein the arm and hook portions are shaped to mate with the slot such that the slot restrains the movement of the seal, wherein size of the seal substantially prevents a cooling flow from leaking through the shank pocket. Further, it is disclosed that the strip like seal bordering the shank portion of a first and a second blade that has a width that substantially prevents a cooling flow from leaking through the shank pocket.

A further sealing arrangement for a turbine blade is disclosed in the document US 2012/0237352 A. The sealing arrangement comprises two circumferentially adjacent arranged blades on a rotor wheel having an enclosed essentially radially oriented groove. The groove has at least one radial seal pin having an essentially uniformly round cross-section.

SUMMARY

It is an object of the invention to provide an enhanced seal arrangement for constricting a leakage flow through a leakage gap between shanks of two adjacent circumferentially arranged blades of a rotary flow machine. A further objective is to simplify the assembling work required to introduce a seal in the slot between two neighboring shanks shall.

Inventively, a blade of a rotary flow machine comprises an air foil having a suction surface and a pressure surface joined together along a trailing and a leading edges, a radially outward directed airfoil tip and a radially inward directed end joining an inner platform that connects the airfoil to a shank at a radial end of the airfoil and further has at least one shank pocket encircled in the radially outward direction by an axially extending portion of the platform. At least one radially extending rim that extends from the trailing edge side of the shank has a radially orientated slot for receiving a seal and a mount that extends radially inwardly from said shank pocket. The blade is characterized by the shank has an aperture on the shank surface oriented in an axial direction.

The axially facing surface of the shank is freely accessible even in the mounted state, i.e. all blades are circumferentially assembled in the rotor wheel. The inventive idea establishes a basis for the possibility to insert a seal after at least two neighboring blades, preferably all blades, are assembled onto a rotor wheel by inserting mounts of each blade into correspondingly shaped recesses in the rotor wheel.

The subsequent introduction of the seals into the slots after complete installation of all blades simplifies installation and reduces installation time associated with the assembling work of a rotary flow machine.

In a preferred embodiment, the shank of each blade has a second slot having an aperture on an opposite surface to the rim. The second slot and aperture preferably are of the same size and shape as the slot and aperture in the at least one radially directed rim. In an assembled state, the shanks of two neighboring blades adjoin each other such that the slot and aperture in the at least one rim of one of the two adjoining blades aligns radially and axially with the second slot and aperture of the other blade. The aligned slots form a cavity with a radially oriented longitudinal extension that preferably has a rectangular cross-section having a circumferential orientation rectangular side that defines the width of the rectangular cavity. In this way both apertures complement each other so as to form a common access opening through which a strip-like seal may be received into the rectangular cavity after the blades are assembled.

Preferably, the strip-like seal received in the rectangular cavity is made of a heat resistant material, most preferable having a length and width which corresponds to the radial extension and width of the rectangular cavity respectively. In other aspects, the shape and size of the seal corresponds to individual arrangements of the slots described in more detail in the following illustrated embodiments.

In all cases the aperture of the slot in the shank and the associated position of the access opening is radially arranged between the platform and the mount of the blade. Preferably, the aperture of the essentially radially oriented slots is arranged at the radially outer end of the slot, that is, the aperture is located radially close to the platform of the blade. This location makes it possible to easily insert the strip-like seal through the access opening of the already assembled blades.

After a seal is introduced into the rectangular cavity precaution must be taken to avoid the strip-like seal escaping through the access opening due to operational centrifugal and axial forces. To overcome this problem, in a preferred embodiment, the slot in the at least one radially directed rim is a grooved-shaped recess having a radially outward end bordered axially by a nose-like contour separating the radially outward end and the slot from the aperture.

The described new design for a radial sealing slot in a shank of a blade enables the insertion of a seal strip after assembly of blades around a rotor wheel. With reference to the accompanying drawings several different embodiments for realizing the slot and the strip seal are described.

An alternative inventive idea for inserting a seal in an essentially radially directed slot in the shank of a blade for reducing or diminishing leakage flow through a gap between the shanks of two adjacent blades to be assembled in one circumferentially row of a rotary wheel will now be described.

In contrast to the previously discussed seal arrangement which allows insertion of strip-like seals after a complete assembly of blade on a rotary wheel a further embodiment enables an easier way of loading the slot with a seal during blade assembly. Furthermore, this embodiment has accurate self-alignment of the seal within the slot bordered by the shanks of two neighboring blades.

In a known arrangement, a blade of a rotary flow machine comprises an airfoil having a suction and a pressure surfaces joining together along a trailing and a leading edge, a radially outward directed airfoil tip and a radially inward directed end joining an inner platform that connects the airfoil to a shank radially opposite airfoil having at least one shank pocket encircled radially outwardly by an axially extending portion of the platform and by at least one radially extending rim of the trailing edge side of the shank having a radially orientated first slot suitable for receiving a seal and a mount extending radially inward from the shank pocket having a second slot arranged on an opposite surface to the rim configured such that when assembling two blades in the circumferential direction of the rotary flow machine both slots form a common gap in which a seal is receivable prior to the assembly the two blades. The received seal is preferably sized to substantially prevent a leakage flow through the shank pocket. The blade is characterized in that one of the two slots has a groove-shaped recess with a width and a depth adapted to a width of a strip-like seal such that a hypotenuse of the width and depth of the groove-shaped recess is of the same size or greater than the width of the strip-like seal. The width of the strip-like seal on the other hand is greater or equal 50% of the length of the hypotenuse, preferably equal or greater than 70% of the length of the hypotenuse.

Due to the geometry and size adaptation between the groove-shaped recess and the strip-like seal it is possible to insert the strip-like seal completely into the groove-shaped recess before assembling the two adjacent blades in circumferentially direction on a rotor wheel. In addition, because the strip-like seal resides completely inside the groove-shaped recess, it is possible to seamless join the two adjacent blades in circumferential direction. In order to ensure that the strip-like seal, which is received along the hypotenuse of the recess during assembly, performs the additional function of an axial facing cover for the gap between the shanks of the two adjacent blades, a tool is necessary to slip the strip-like seal from the starting position along the hypotenuse into the axial sealing position.

To facility the slipping and rotating motion of the strip-like seal from the position along the hypotenuse to the end position the grooved-shaped recess has along its width a wedge-like contour with a flank portion inclined relative to the axial direction so that one side edge of the strip like seal can be slid along the flank while the strip-like seal is rotating around its length extension into the axial direction so as to seal the gap between the shanks of two adjacent blades to prevent a leakage flow through the shank pocket.

The flank of the wedge-like contour is located adjacent to a first limiting wall of the groove-shaped recess while the wedge-like contour limits a first gap with a second limiting wall located opposite to the first limiting wall. In an assembled configuration of the two blades in circumferentially direction the second slot has at least a second gap facing the first gap so that axial ends of the strip-like seal projects into both gaps simultaneously.

A further preferred embodiment has a helical contour along the radial direction of one limiting wall inside the grooved-shaped recess such that the strip-like seal, which initially takes the position along the hypotenuse of the grooved-shaped recess during assembling the blades, will turn itself without any tooling by means of centrifugal forces applied during the first commissioning. As will be described in more detail with a reference to the figures, the helical contour is provided only in a radial outward region along the grooved-shaped recess. Further details of the invention can be derived from the following disclosure describing preferred embodiments shown in the figures.

BRIEF DESCRIPTION OF THE DRAWINGS

The invention shall now be explained in more detail based on exemplary embodiments in conjunction with the drawing. In the drawing

DETAILED DESCRIPTION

FIG. 1 illustrates a first embodiment of a blade 1 of, for example, a moving low pressure turbine blade for a gas turbine arrangement. FIG. 1A shows a side view in the circumferential direction c of rotary flow machine (not shown) of the radially inner section of the blade 1. The axes shown in FIG. 1A mark the axial direction a, the radial direction r and the circumferential direction c of the rotary flow machine. The further description makes reference to the axes defined in each illustration.

Figure 1A:
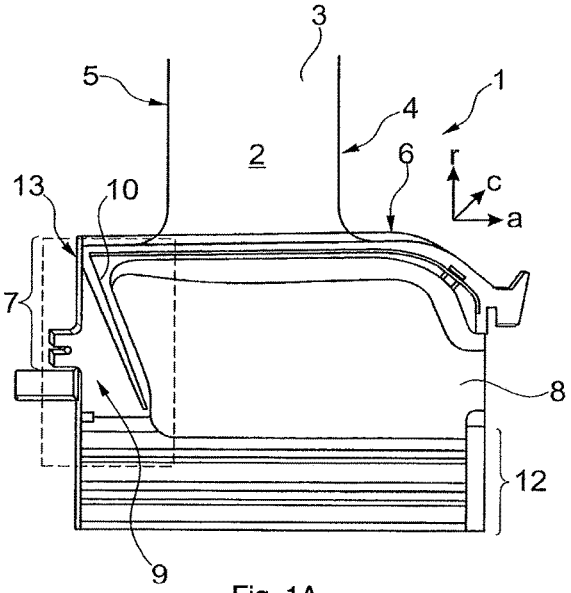
FIGS. 1A-1D show a first embodiment of an inventive blade according to a first inventive aspect.
Figure 1B:
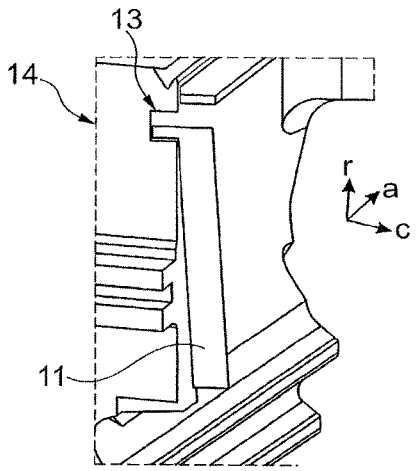

The blade 1 comprises an airfoil 2 having a suction surface 3 and a pressure surface (not shown) joined together along a leading edge 4 and trailing edge 5. The radially inwardly extending end of the airfoil 2 joins an inner platform 6 connecting the airfoil 2 to a shank 7 at a radial end of airfoil 2. The shank 7 has at least one shank pocket 8 which is defined as an area recessed in the shank 7 that is radially encircled by an axially a portion of the platform 6 and by at least one radially directed rim 9 that extends from the trailing edge 5 side of the shank 7. The shank 7 has a slot 10, as shown in FIG. 1B, orientated radially r for receiving a seal 11 essentially in the axial direction a. The blade 1 further comprises a mount 12 extending radially inward from the shank pocket 8 for fixing the blade 1 into a counter-contoured recess in a rotor-wheel of the rotary flow machine.

Figure 1C:
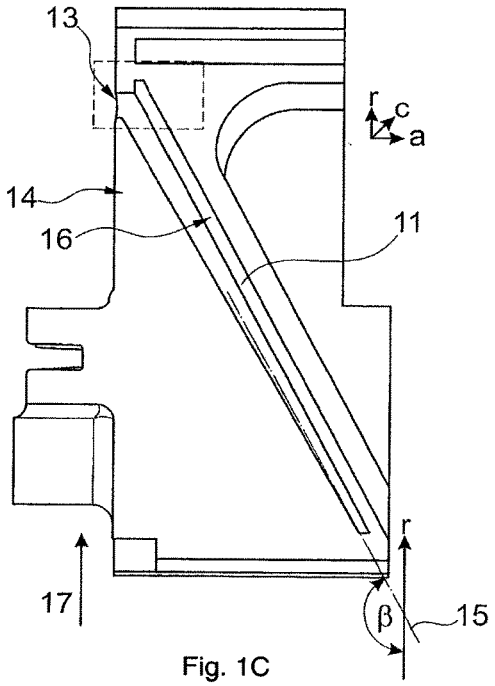
Figure 1D:
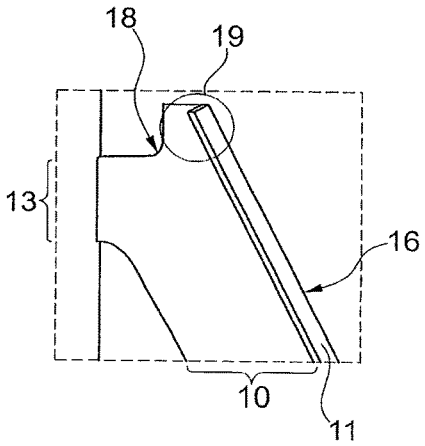

Embodiments of the seal arrangement will be further description with reference to I FIGS. 1A-1D. FIG. 1C is an enlarged view of the section of FIG. 1A enclosed by a dashed line. FIG. 1D shows an enlarged view of the section FIG. 1C enclosed by a dashed line FIG. 1C shows a slot 10 configured as a wedge-like grooved-shaped recess with an axial recess width becoming narrower towards the radially inward direction. The slot 10 has an aperture 13 which merges at a shank surface 14 oriented to face an axial direction a. The aperture 13 is connected to the slot 10 such that a seal 11, preferably in form of a rectangular strip-like metal seal, as shown in FIG. 1B, can be inserted through the aperture 13 into the slot 10. The length of the seal 11 corresponds to the length of the slot 10. The slot 10 has a longitudinal axis 15 which is incline to the radial direction r by an angle β in the range of $100° < \beta < 170°$ preferably $130° < \beta < 150°$. Due to the inclination of the slot 10 the seal 11, which is inserted into the slot 10, is pressed against the radial outward surface 16 of the slot 10 by centrifugal forces 17 acting onto the seal 11 during rotation around an axis of rotation of the rotary flow machine. Due to the effect of centrifugal forces 17 onto the seal lithe seal 11 is pressed in a gastight manner against the surface 16 countering pressure in the shank pocket 8 acting onto the seal 11.

To avoid an uncontrolled escape of the seal 11 out of the slot 10 through the aperture 13 the slot has at its radially outward end a nose-like contour 18 which separates the radially outward end 19 of the slot 10 from the aperture 13 in the axial direction. In FIG. 1D it is illustrated clearly that the seal 11 is secured in the radially outward end 19 of the slot 10 by the nose-like contour 18.

The blade 1 has an opposed side in circumferential direction c to the represented side shown in FIGS. 1A-1D. At this opposed side the shank 7 has a second slot with an aperture which is a mirror image of the slot and aperture in the rim 9, so that when assembling two blades in circumferential direction c of the rotary flow machine both slots enclose a common gap and form a common aperture through which the seal 11 can be received wherein the seal is sized to prevent a leakage flow through the shank pocket 8. FIG. 1B shows an inserted seal into the slot 10. The circumferentially c protruding part of the seal 11 extends over the slot 10 into the second slot of a blade assembled adjacent to the blade shown in FIG. 1B.

In the following description previously referenced reference numbers will be discussed without repeated explanation.

Figure 2A:
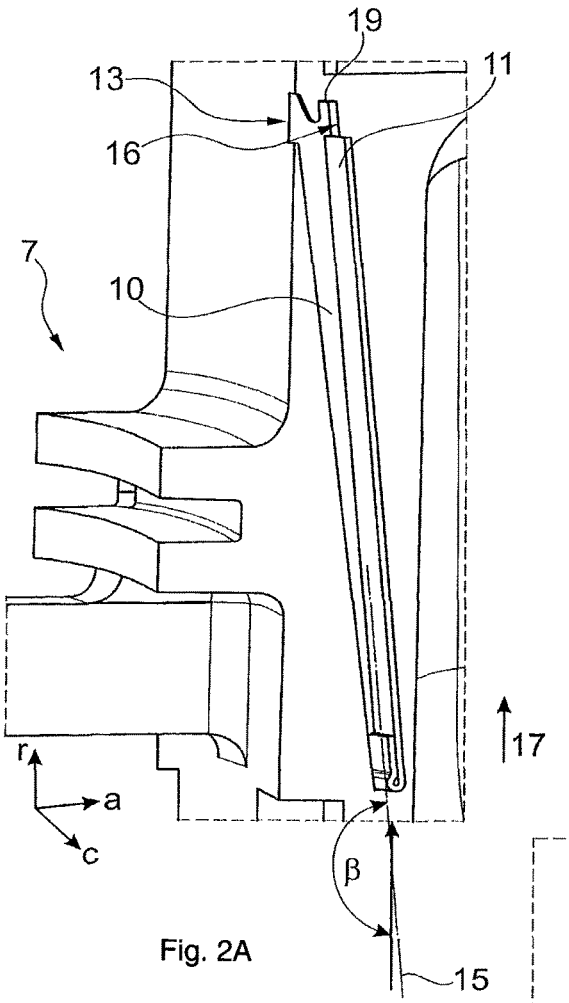
FIGS. 2A-2C show a second embodiment of an inventive blade according to the first inventive aspect.
Figure 2B:
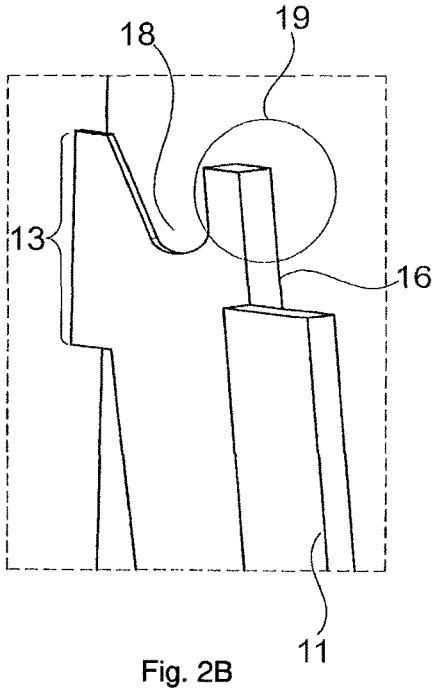
Figure 2C:
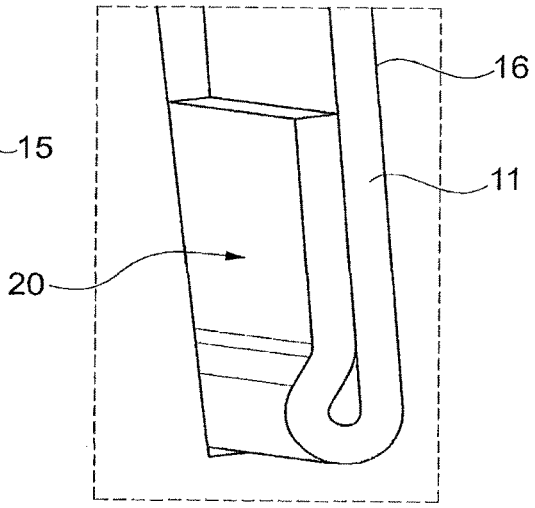

FIG. 2A is a perspective view of the shank portion 7 of a blade that is comparable to the embodiment shown in FIG. 1C. Slot 10 has a wedge-like grooved-shaped recess that narrower in the radially inward direction r. The slot 10 is connected to an aperture 13 in the region of the radial outward directed end of the slot 10. In contrast to the embodiment shown in FIG. 1C the longitudinal axis 15 of the slot 10 is inclined to the radial direction r by an angle β greater than in case of FIG. 1C. By this means it is possible to configure rim 9 with a smaller axial width than for the configuration shown in FIG. 1C. Further to ensure that the seal 11 contacts the radial outward surface 16 of the slot 10 the seal 11, which is a metal strip, has at its radially inner end an overfold feature 20 that is compressed at the radially inner end of the slot 10 such that the seal 11 is forced against the surface 16. It is further expected that after the rotary flow machines starts up, due to the centrifugal forces 17, the seal 11 will move to the radially outer end 19, marked by a ring in FIG. 2B.

Figure 3A:
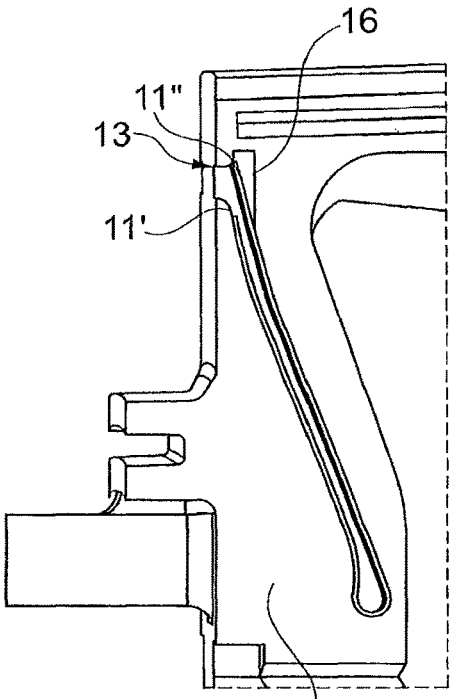
FIGS. 3A-3C show a first embodiment of an inventive blade according to the first inventive aspect.
Figure 3B:
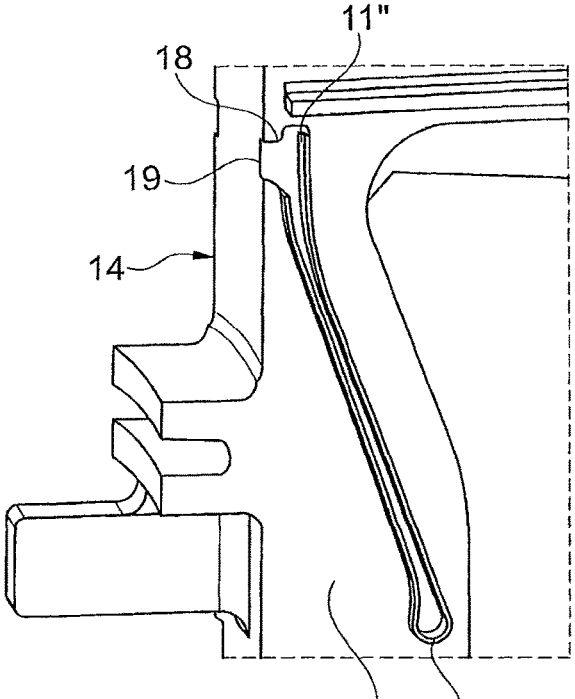
Figure 3C:
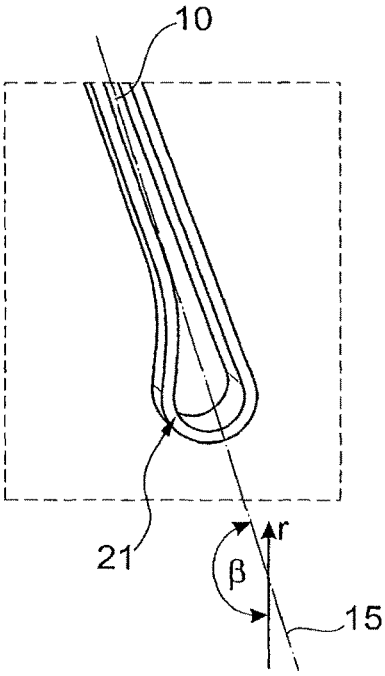

FIGS. 3A-3C show a third preferred embodiment in which a radial seal is introduced into a slot 10 formed after blades are assembled on a rotary wheel. Here the slot 10 has a contoured grooved-shaped recess adapted for a clasped-like seal 11. The slot 10 comprises a bent strip having two close together strip ends 11', 11" at the radially outward end 19 of the slot 10 and a curved bent section 21 at the radially inward extending end of the slot 10.

The curved bent section 21 of the seal 11 pushes the clasped-like seal 11 against the inner axial surfaces of the contoured grooved-shaped recess of the slot 10. This can be seen in FIGS. 3A-3C. The contoured grooved-shaped recess further has a longitudinal axis 15 which is slightly inclined to the radial direction r so that the upper strip end 11", which does not fit tightly at the radially outward surface 16 of the slot 10 as can be seen in FIG. 3A, can move into a sealing location shown in FIG. 3B as a result of centrifugal forces 17 generated during operation of the rotary flow machine. In addition a nose-like contour 18 prevents the strip end 11" moving through the aperture 13 when the rotary flow machine is in stand still mode.

FIGS. 4A-4D show a fourth embodiment of a blade having a radially slot with an aperture formed after blade assembled in a rotary wheel for receiving a seal. The section of the shank 7 shown in FIG. 4A has a rim 9 which is very small in axial direction and a slot 10 that forms an essentially rectangular grooved recess having a longitudinal axis 15 that is aligned radially without any inclination towards the radial direction r. The slot 10 has at its radially outer end an introduction slot 22 connecting the aperture 13 with the slot 10. The introduction slot 22 has an axis 23 which intersects the axis 15 of the slot 10 at an angle α in the range of $120° <= \alpha <= 150°$, preferably $125° <= \alpha <= 140°$, most preferably $\alpha = 131°$.

Figure 4A:
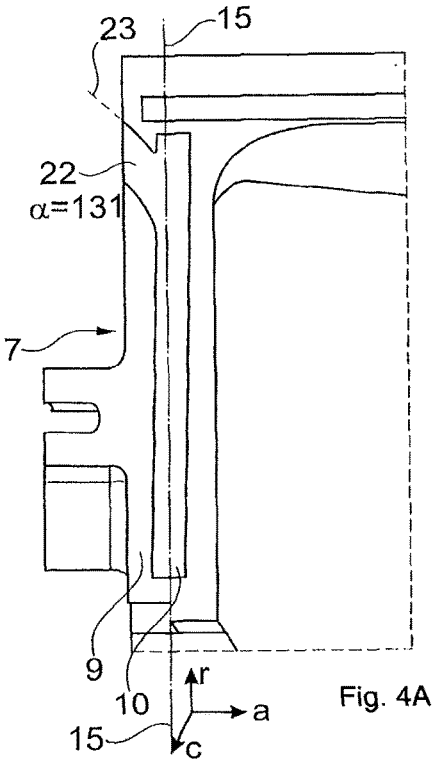
FIGS. 4A-4D show a fourth embodiment of an inventive blade according to the first inventive aspect.
Figure 4B:
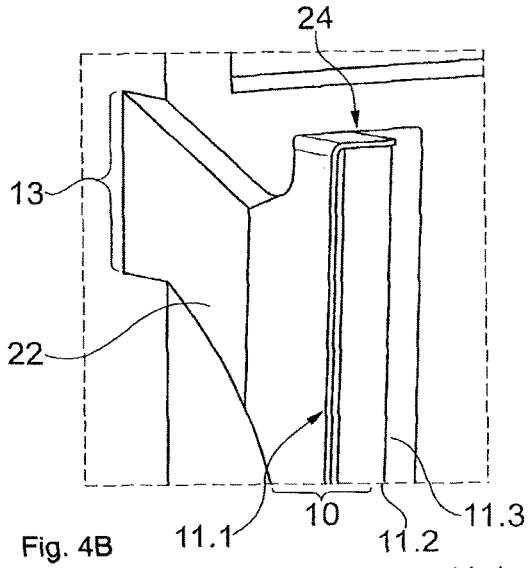
Figure 4C:
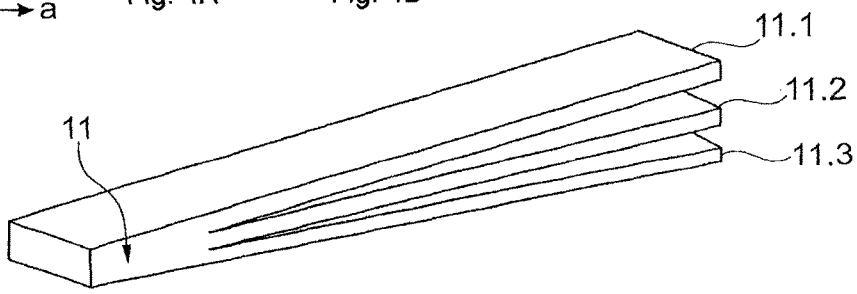
Figure 4D:
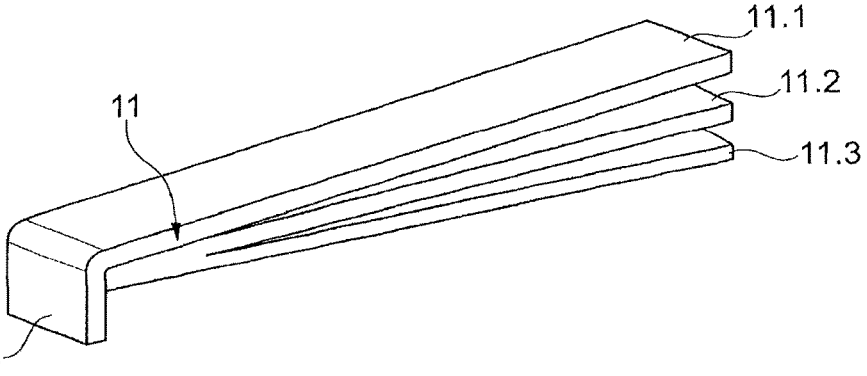

FIGS. 4A and 4B show an embodiment of a rectangular slot 1 that is suitable for the receiving a specially designed seal arrangement shown in FIGS. 4C and 4D. The specially designed 11 consists of a multiple strip design that a smaller groove angle α of insertion of the seal through the aperture 13 into the slot 10. A preferred multiple strip design shown in FIG. 4C has three strip-like seals 11.1, 11.2, 11.3 spot welded together at one common end so that the three strip-like seals form a fan-shaped as shown in FIG. 4C. In a preferred embodiment one of the three strip-like seals has a greater thickness than the two others, for example a first strip-like seal 11.3 has a thickness of 0.5 mm while the other two 11.1, 11.2 have a thickness of 0.2 mm. A thicker strip seal has the advantage of avoid buckling while a thinner strip has increased resilience to plastic deformation when bend during assembly.

FIG. 4D shows another embodiment of a strip-like seal 11 also having three strip-like seals 11.1, 11.2, 11.3 joined at a common end so that the strip-like seals form a fan-shaped. As shown in FIG. 4B one of the strip-like seals 11.1 extends to form a lip 24 for locating the seal arrangement safely in the slot 10.

The blades shown in the FIGS. 1-4 commonly has an aperture 13 formed after blade assembly through which a strip-like seal or a multi strip design is receivable into a freely accessible surface oriented to face in an axial direction a of the rotary flow machine. The blades shown in the f FIGS. 5 and 6 have a slot that extends in the radial direction. The slot is configured to enable the insertion of a seal during assembly work without hindering or impeding the assembly work.

Figure 5A:
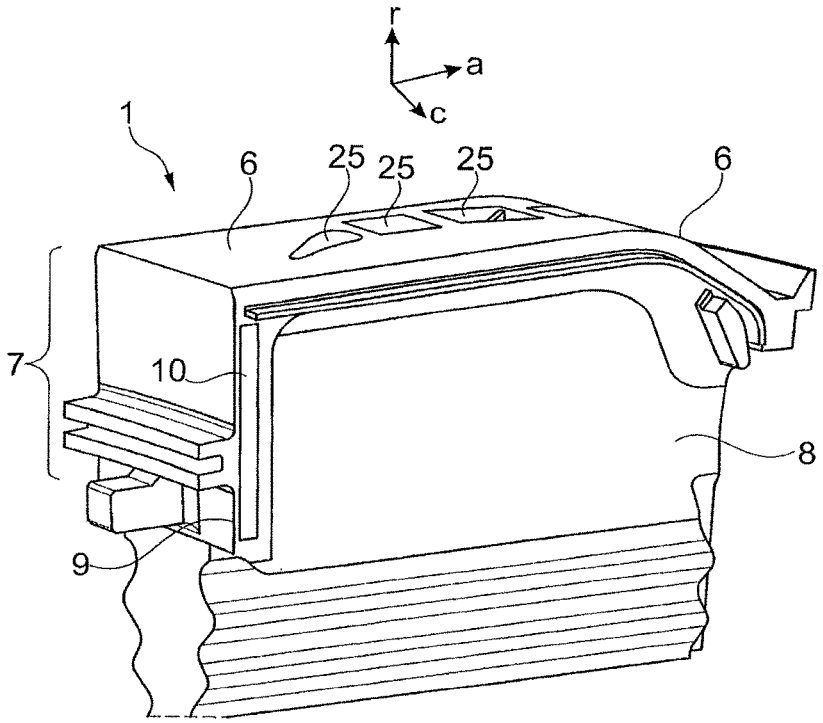
FIGS. 5A-5D show a first embodiment of an inventive blade concerning to the second inventive aspect.

FIG. 5A shows a perspective view of a blade 1 without an airfoil that would otherwise extend radially beyond the platform 6 from where cooling openings 25 are arranged.

The shank pocket 8 of the blade 1 is radially encircled by both a portion of the platform 6 that extends axially and by at least one radially directed rim 9 extending from the trailing edge side of the shank 7. The rim 9 includes a radially oriented slot 10 for inserting a seal. In contrast to the before described embodiments the slot 10 does not have an access aperture for insertion the seal into the slot. Instead, the slot 10 is completely embedded into the rim 9 while having a single circumferentially oriented c opening on one side.

Figure 5B:
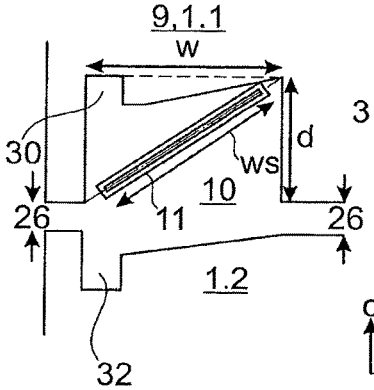
Figure 5C:
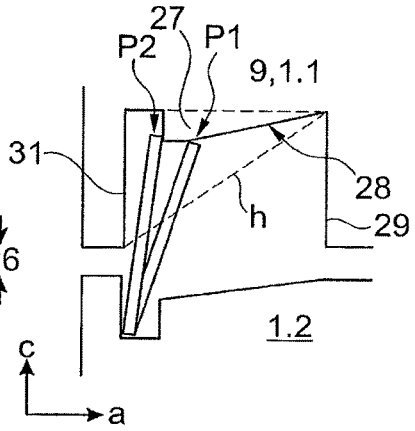
Figure 5D:
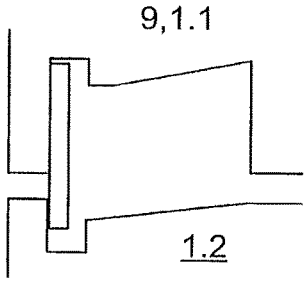

FIGS. 5B-5D show a cross-section of the slot 10. In FIG. 5B the illustrated upper cross-section shows a slot 10 in the rim 9 of a first blade 1.1 that borders a gap 26 formed in the circumferential direction c by a second blade 1.2 that is arranged adjacent to the first blade 1.1 in the circumferential direction of a rotary wheel (not shown).

The slot 10 of the first blade 1.1 has a rectangular cross-section (see dashed line) having a slot width w and a slot depth d. According to the rectangular geometry of the slot 10 the slot 10 has a hypotenuse h wherein $w^2+d^2=h^2$.

In addition, the strip-like seal 11 has a rectangular cross-section having a seal width ws equal or less than the length of the hypotenuse h but equal or greater than 50% but preferably equal or greater than 70% of the length of the hypotenuse h. With the aforementioned mentioned geometrical requirements, it is possible to place the seal 11 inside the slot 10 so that the seal 11 does not project beyond the slot 10 in circumferential direction c as shown in FIG. 5B. Here the seal 11 takes a position along the hypotenuse h of the slot 10. In this position, it is possible to place an adjacent second blade onto the rotor wheel without disturbing with the seal 11 located inside the slot 10.

After assembling two adjoining blades onto the rotary wheel the strip-like seal 11 has to be moved into a sealing position so as to close the an axial gap 26 axially, as shown in FIG. 5D. To facilitate the movement of the strip-like seal 11, slot 10 has along its width, i.e. in an axial direction, a wedge-like contour 27 with a flank 28 inclined relative to the axial direction a. In addition, the flank 28 is located adjacent to a first limiting wall 29 of the slot 10. In this arrangement, the wedge-like contour 27 further limits a first gap 30 with a second limiting wall 31 located facing, in the axial direction, the first limiting wall 29 of the slot. Additionally, the second blade 1.2, as it is arranged circumferentially to the first blade in the assembled configuration, it has a second gap 32 that faces the first gap 30.

To move the strip-like seal 11 from the position shown in FIG. 5B to the axial sealing position shown in FIG. 5D a tool is necessary to slide an end of the strip-like seal 11 along the flank 28 in axial direction whereby the sliding causes the other end of the strip-like seal 11 to enters the second gap 32 of the second blade 1.2. In the position shown in to FIG. 5C, the strip-like seal 11 has to be pushed using axial force to move from the position P1 shown in FIG. 5C to position P2, i.e. so that the strip-like seal 11 is axially inside the first and second gap 30, 32 of the first and second blade 1.1, 1.2.

Figure 6B:
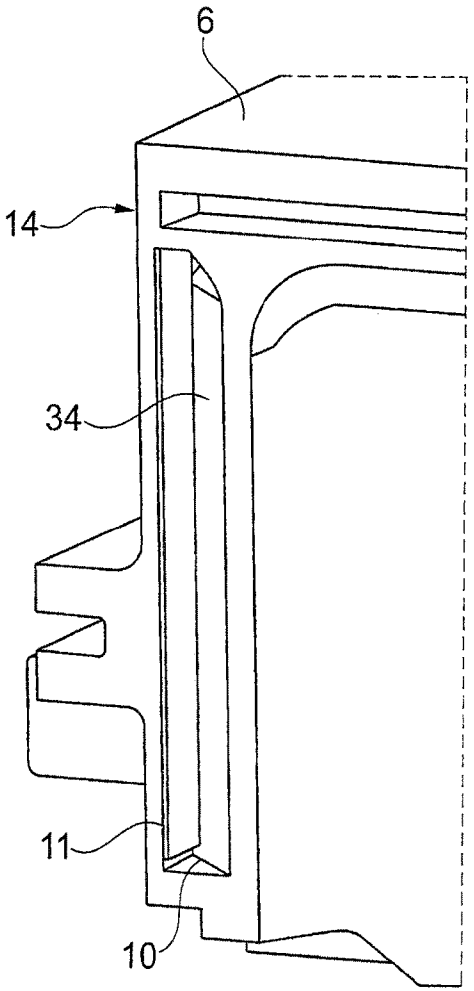
FIGS. 6A and 6B show a second embodiment of an inventive blade concerning to the second inventive aspect.
Figure 6A:
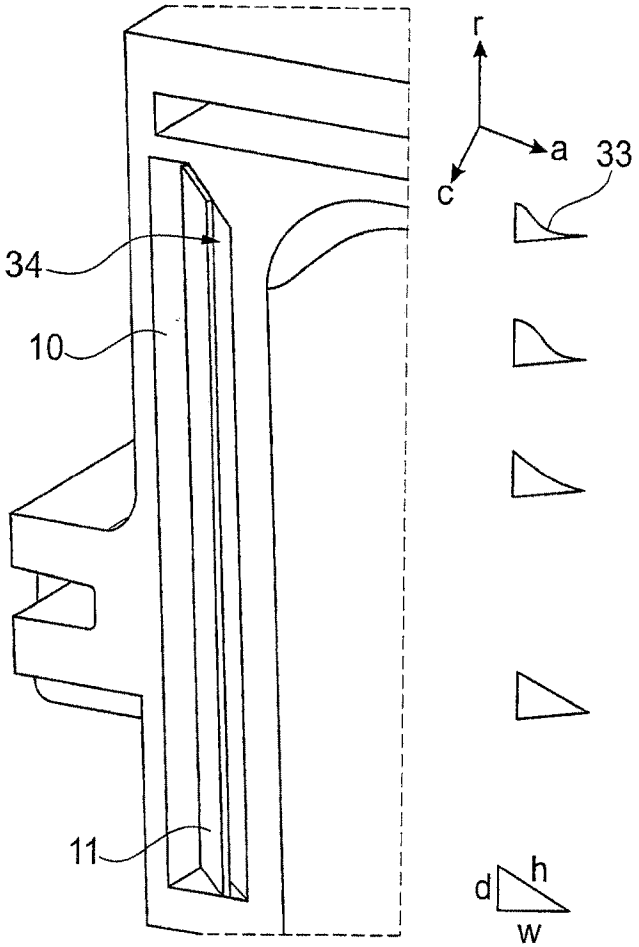

FIGS. 6A and 6B show an alternative embodiment of a blade having a radially directed slot 10 having a cross-section that enable the movement of the strip-like seal into the slot 10 after positioning the strip-like seal 10 along the hypotenuse h of the cross-section of the slot. In of FIG. 6A the slot 10 is extends radially r and has a radially inward end having a triangle cross-section that has a depth d, a width w and a hypotenuse h. The slot 10 further has a radially outward end having a cross-section in which the hypotenuse h forms a convex contour 33. There is a transition along the radial height of the slot 10 from a straight hypotenuse h at one end of the slot 10 to a convex contoured 33 hypotenuse h resulting in a surface of the slot 10 forming a helical contour 34. FIG. 6A shows the strip-like seal 11 located in the slot 10 before the assembly of an adjoining blade into the rotary wheel in circumferential direction. FIG. 6B shows the location of strip-like seal 11 in its axial sealing position. The transition from the seal location shown in FIG. 6A and the seal location shown in FIG. 6B is achieved by centrifugal forces 17 acting onto the strip-like seal 11 during operation of the rotary wheel wherein centrifugal forces move the strip-like seal in a radial direction resulting in a twisting of the strip-like seal as a result of the helical groove-shaped contour 34 of the slot 10 as it is forced up the slot 10.

The invention claimed is:

1. A blade of a rotary flow machine, comprising:

an airfoil having a suction surface and a pressure surface joining each other along a trailing and a leading edge;

a radially outward directed airfoil tip;

a radially inward directed end joining an inner platform connecting the airfoil to a shank at a radial end of the airfoil;

at least one shank pocket encircled radially outward directed by a portion of the platform extending axially and by at least one radially directed rim extending at the trailing edge side of the shank having a first slot orientated radially mainly for insertion of a seal; and a mount extending radially inward from said shank pocket, the shank further having a second slot arranged on an opposite surface to the rim configured such that when assembling two blades in circumferential direction of the rotary flow machine, the first and second slots enclose a common gap in which a seal is introducible before assembling the two blades, the seal being sized to substantially prevent a leakage flow through the shank pocket, wherein one of the first and second slots has a groove-shaped recess with a width (w), a depth (d) and a hypotenuse (h) being adapted to a width (ws) of a strip-like seal such that: $w^2+d^2=h^2$ and $ws \geq 0.5$ h.

2. The blade of claim 1, wherein the grooved-shaped recess has along its width a wedge-like contour having a flank inclined relative to an axial direction, said flank being adjacent to a first limiting wall of said groove-shaped recess, said wedge-like contour further limiting a first gap with a second limiting wall opposite to the first limiting wall, and the second slot having at least a second gap facing the first gap in an assembled configuration of the two blades.

3. The blade of claim 1, wherein the grooved-shaped recess has at one limiting wall a helical contour along the radial direction.

* * * * *